US007780475B1

(12) United States Patent
Parker et al.

(10) Patent No.: US 7,780,475 B1
(45) Date of Patent: Aug. 24, 2010

(54) SOCKET CONNECTOR FOR A RELAY

(75) Inventors: David Glen Parker, Trinity, NC (US); Victor Eugene Slack, Lewisville, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/477,039

(22) Filed: Jun. 2, 2009

(51) Int. Cl.
*H01R 13/66* (2006.01)

(52) U.S. Cl. ..... 439/620.06; 439/709

(58) Field of Classification Search ..... 439/76.2, 439/147, 620.05–620.08, 638, 709
See application file for complete search history.

(56) References Cited

U.S. PATENT DOCUMENTS 5,403,207 A 4/1995 Briones
5,872,492 A 2/1999 Boutros
6,912,781 B2 7/2005 Morrison et al.
6,946,942 B1 9/2005 Chih-Min
6,986,684 B1 1/2006 Lien
7,230,515 B2 6/2007 Takeda et al.
7,456,717 B2 11/2008 Grueso et al.

*Primary Examiner*—Khiem Nguyen

(57) ABSTRACT

A socket connector is provided for electrically connecting an electromagnetic relay to a plurality of electrical wires that are terminated by a mating connector. The socket connector includes a dielectric housing having a relay mounting base and a wire connector. The relay mounting base includes at least one relay receptacle. The relay mounting base is configured to receive the electromagnetic relay thereon. A plurality of terminals is held by the housing. Each terminal includes a relay contact portion and a connector contact portion. The relay contact portion extends within the at least one relay receptacle for electrical connection with the electromagnetic relay. The connector contact portion extends within the wire connector for electrical connection to the mating connector.

20 Claims, 5 Drawing Sheets

SOCKET CONNECTOR FOR A RELAY

BACKGROUND OF THE INVENTION

The subject matter described and/or illustrated herein relates generally to electromagnet relays, and, more particularly, to a socket connector for an electromagnetic relay.

Electromagnetic relays may include a variety of different electrical connections. For example, electromagnetic relays typically include a coil and one or more stationary contacts. The coil is electrically connected to an electricity source for receiving electricity to energize the coil during operation of the relay. The stationary contact(s) is electrically connected to an electrical output of the relay. Specifically, when the stationary contact(s) is engaged with a movable contact of the relay, an electrical path through the movable and stationary contacts is closed to thereby output electricity from the relay. A plurality of separate electrical wires provides the connections to the electricity source and the electrical output. The relay includes a plurality of electrical contacts that are each electrically connected to the coil, the stationary contact(s), or another component of the electromagnetic relay for connecting such components to the electrical wires.

Typically, to operationally connect the relay to the electricity source, the outlet, and/or other electrical connections, each electrical wire is individually mated with the corresponding electrical contact of the relay. For example, an intermediary contact that terminates the end of the electrical wire is mated with the corresponding electrical contact of the relay. Because each electrical wire is individually mated with the relay, a relatively high number of individual connections must be made to operationally connect the relay to the electricity source, the outlet, and/or other electrical connections. Moreover, the number of individual connections to the relay may be increased even further because individual components of the relay often include a plurality of electrical contacts that are each individually connected to a different electrical wire. Such a relatively high number of individual connections to the relay may cause mis-wiring of the electromagnetic relay, and/or may make it more difficult and/or time consuming to operationally connect the relay to the electricity source, the outlet, and/or other electrical connections.

BRIEF DESCRIPTION OF THE INVENTION

In one embodiment, a socket connector is provided for electrically connecting an electromagnetic relay to a plurality of electrical wires that are terminated by a mating connector. The socket connector includes a dielectric housing having a relay mounting base and a wire connector. The relay mounting base includes at least one relay receptacle. The relay mounting base is configured to receive the electromagnetic relay thereon. A plurality of terminals is held by the housing. Each terminal includes a relay contact portion and a connector contact portion. The relay contact portion extends within the at least one relay receptacle for electrical connection with the electromagnetic relay. The connector contact portion extends within the wire connector for electrical connection to the mating connector.

Optionally, the wire connector includes a mating connector receptacle configured to receive the mating connector therein, wherein the connector contact portion of at least some of the plurality of terminals extends within the mating connector receptacle. Each of the plurality of terminals optionally extends a length from the relay contact portion to the connector contact portion, wherein an intermediate link extends between and electrically connects the relay and connector contact portions. The wire connector optionally includes a Raster Anschluss Steck Technik (RAST) connector. Optionally, the housing includes an internal cavity and at least a portion of each of the plurality of terminals extends within the internal cavity. The housing optionally includes a mounting element for mounting the housing on a panel, a din rail, and/or a circuit board.

The relay contact portions of the plurality of terminals optionally include receptacle contacts. Optionally, the connector contact portions of the plurality of terminals include plug contacts. The relay mounting base of the housing optionally includes a plurality of relay receptacles, wherein the relay contact portion of each of the plurality of terminals extends within a corresponding one of the relay receptacles. Optionally, the relay contact portion and the connector contact portion of each of the plurality of terminals include opposite ends of the terminal.

In another embodiment, a socket connector assembly is provided for connection with a mating connector that terminates a plurality of electrical wires. The socket connector assembly includes a socket connector having a dielectric housing including a relay mounting base and a wire connector. The relay mounting base includes at least one relay receptacle. A plurality of terminals is held by the housing. Each terminal includes a relay contact portion and a connector contact portion. The relay contact portion extends within the at least one relay receptacle. The connector contact portion extends within the wire connector for electrical connection to the mating connector. The socket connector assembly also includes an electromagnetic relay received on the relay mounting base of the socket connector. The electromagnetic relay includes a plurality of relay contacts. Each relay contact is received within the at least one relay receptacle and engaged with the relay contact portion of a corresponding one of the plurality of terminals.

DETAILED DESCRIPTION OF THE INVENTION

Figure 1:
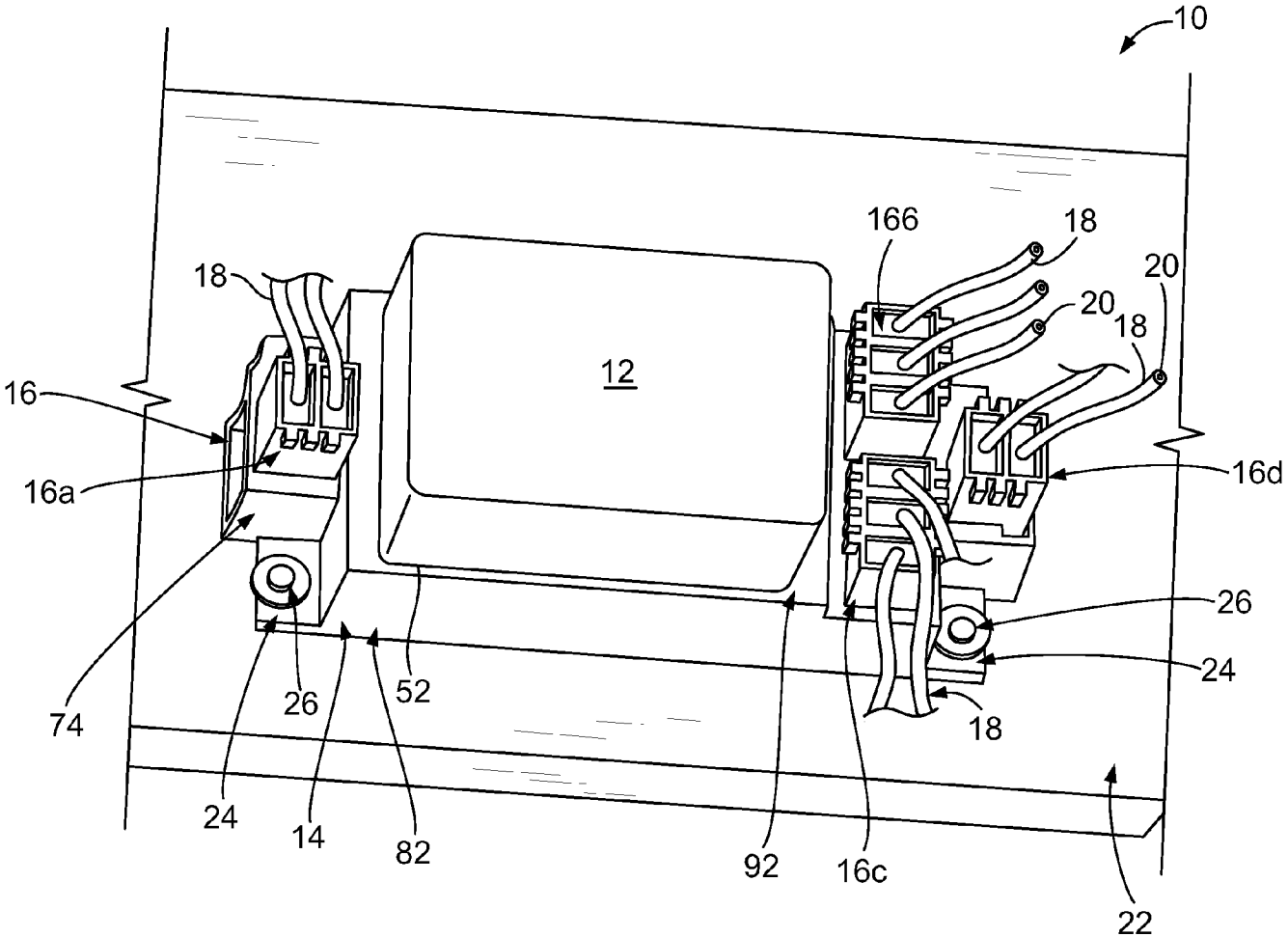
FIG. 1 is a perspective view of an exemplary embodiment of a socket connector assembly.

FIG. 1 is a perspective view of an exemplary embodiment of a socket connector assembly 10. The socket connector assembly 10 includes an electromagnetic relay 12, a socket connector 14, and one or more mating connectors 16. The electromagnetic relay 12 is mounted on and electrically connected to the socket connector 14. Each of the mating connectors 16 terminates a plurality of electrical wires 18. The mating connectors 16 are mated with and electrically connected to the socket connector 14. As will be described below, the socket connector 14 electrically connects the electromagnetic relay 12 to the plurality of electrical wires 18.

In the exemplary embodiment, each electrical wire 18 includes a single electrical conductor 20. Alternatively, one or more of the electrical wires 18 includes more than one electrical conductor 20, such that the electrical wire(s) 18 may be considered a cable. For example, in some embodiments, one or more of the electrical wires 18 is a cable that includes a plurality of electrical conductors 20 that are each surrounded by a separate insulator (not shown) and an insulative jacket (not shown) that surrounds the insulated electrical conductors 20. Moreover, and for example, in some embodiments one or more of the electrical wires 18 is a coaxial cable.

The socket connector assembly 10 is optionally mounted on any structure and/or the like, such as, but not limited to, a panel, a din rail, a circuit board, and/or the like. In the exemplary embodiment, the socket connector assembly 10 is mounted on a circuit board 22. Specifically, in the exemplary embodiment, the socket connector 14 is mounted on the circuit board 22 using one or more mounting elements 24 and/or one or more fasteners 26, as described below. In some embodiments, the socket connector 14 is electrically connected to the circuit board 22. For example, the socket connector 14 may include an electrical contact (not shown) that is electrically connected to the circuit board 22, such as, but not limited to, for supplying electrical power and/or electrical ground to one or more electrical terminals 70 (FIGS. 5 and 6) of the socket connector 14. The socket connector assembly 10 may be mounted on the structure adjacent one or more other socket connectors (not shown). In some embodiments, adjacent socket connector assemblies 10 may be electrically connected together. Specifically, one or more electrical terminals 70 of the socket connector assembly 10 may be electrically connected to one or more electrical terminals (not shown) of the adjacent socket connector assembl(ies).

Figure 2:
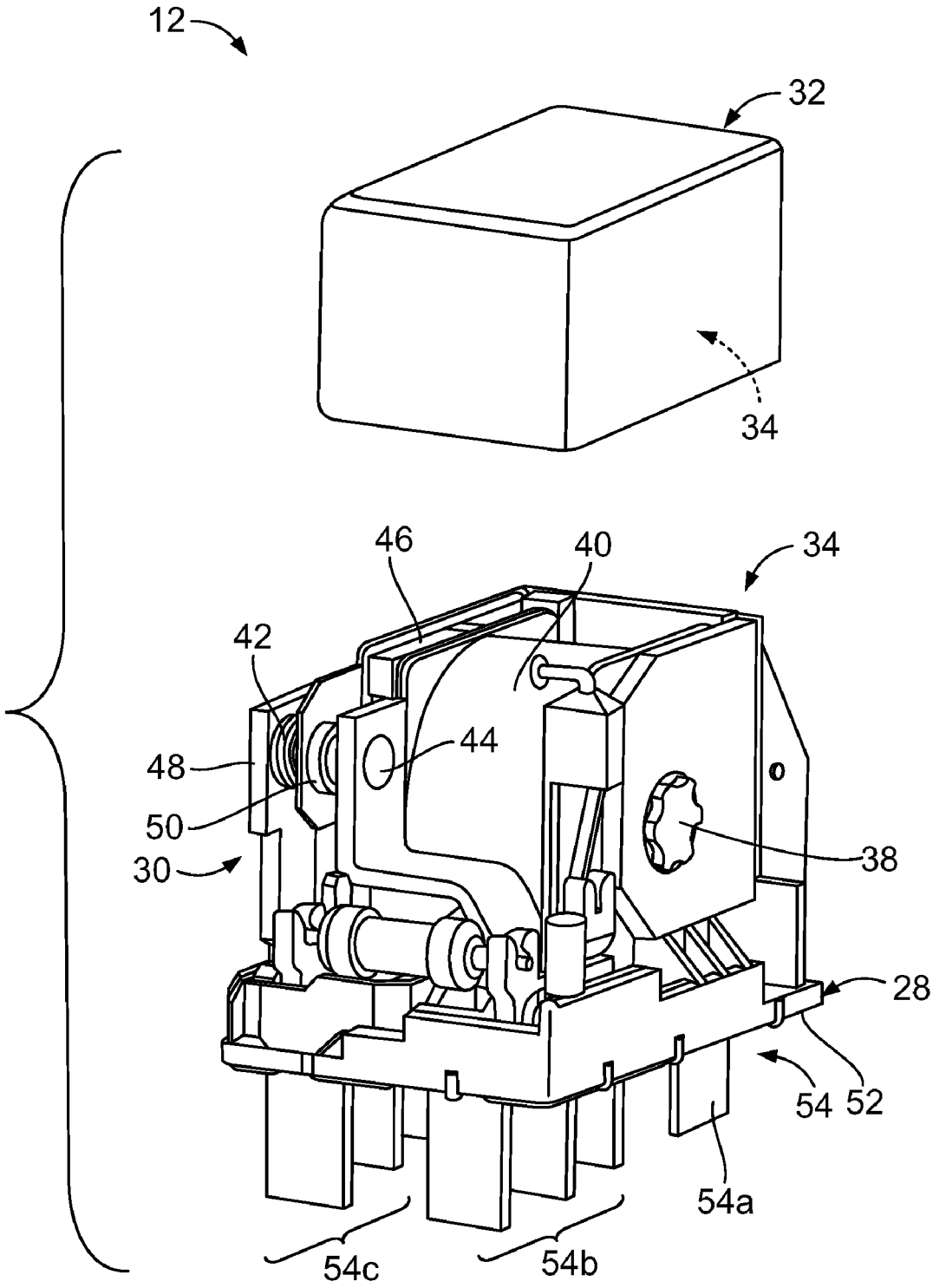
FIG. 2 is a partially exploded perspective view of an exemplary embodiment of an electromagnetic relay of the socket connector assembly shown in FIG. 1.

FIG. 2 is a partially exploded perspective view of an exemplary embodiment of an electromagnetic relay 12. In the exemplary embodiment, the electromagnetic relay 12 is a T92 electromagnetic relay that is commercially available from Tyco Electronics Corporation of Middletown, Pa. Alternatively, the electromagnetic relay 12 is any other type of electromagnetic relay, such as, but not limited to, a T9A electromagnetic relay that is commercially available from Tyco Electronics Corporation of Middletown, Pa., and/or the like. The electromagnetic relay 12 includes a base 28, a plurality of relay components 30 mounted on the base 28, and a cover 32. The cover 32 and the base 28 define an interior cavity 34. The cover 32 cooperates with the base 28 to enclose the relay components 30 within the interior cavity 34. The relay components 30 include a core 38 that is surrounded by a coil 40 and normally open and normally closed stationary contacts 42 and 44, respectively. An armature 46 is attached to a movable spring 48. A movable contact 50 is also attached to the spring 48. The movable contact 50 is moved between engagement positions with the stationary contacts 42 and 44 depending upon the current flow through the coil 40. When the current flow through the coil 40 is sufficient to move the armature 46 toward the core 38, the movable contact 50 is moved to engage the stationary contact 44 thus energizing the electromagnetic relay 12. In the absence of sufficient current in the coil 40 to move the armature 46, the movable contact 50 is in engagement with the contact stationary contact 42, wherein the electromagnetic relay 12 is de-energized. In the exemplary embodiment, the electromagnetic relay 12 includes two stationary contacts 42 and 44. However, the electromagnetic relay 12 may include any number of stationary contacts 42 and/or 44. Moreover, each stationary contact 42 and 44 may be a normally open or a normally closed stationary contact.

Figure 3:
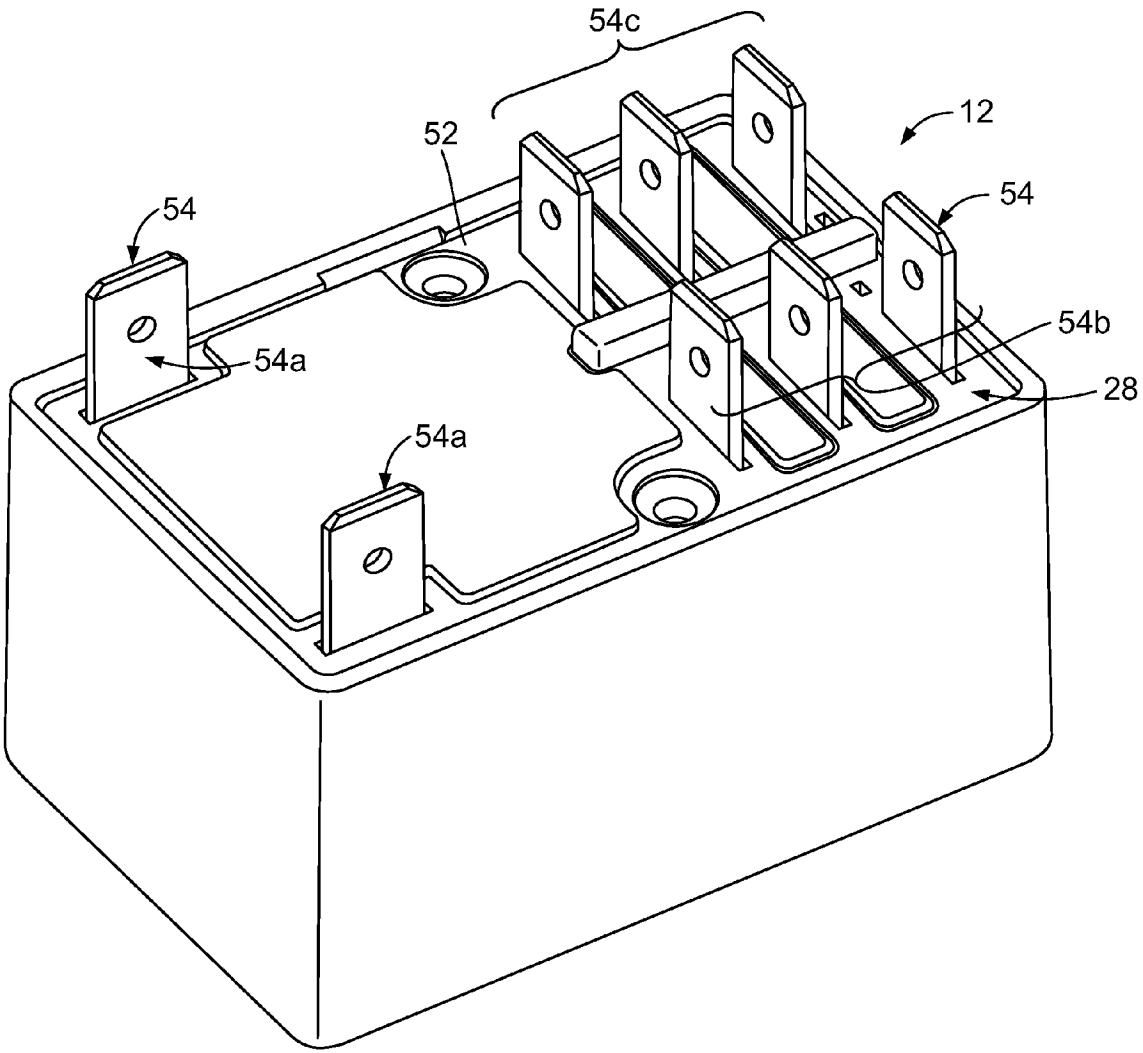
FIG. 3 is a perspective view of the electromagnetic relay shown in FIG. 2.
Figure 5:
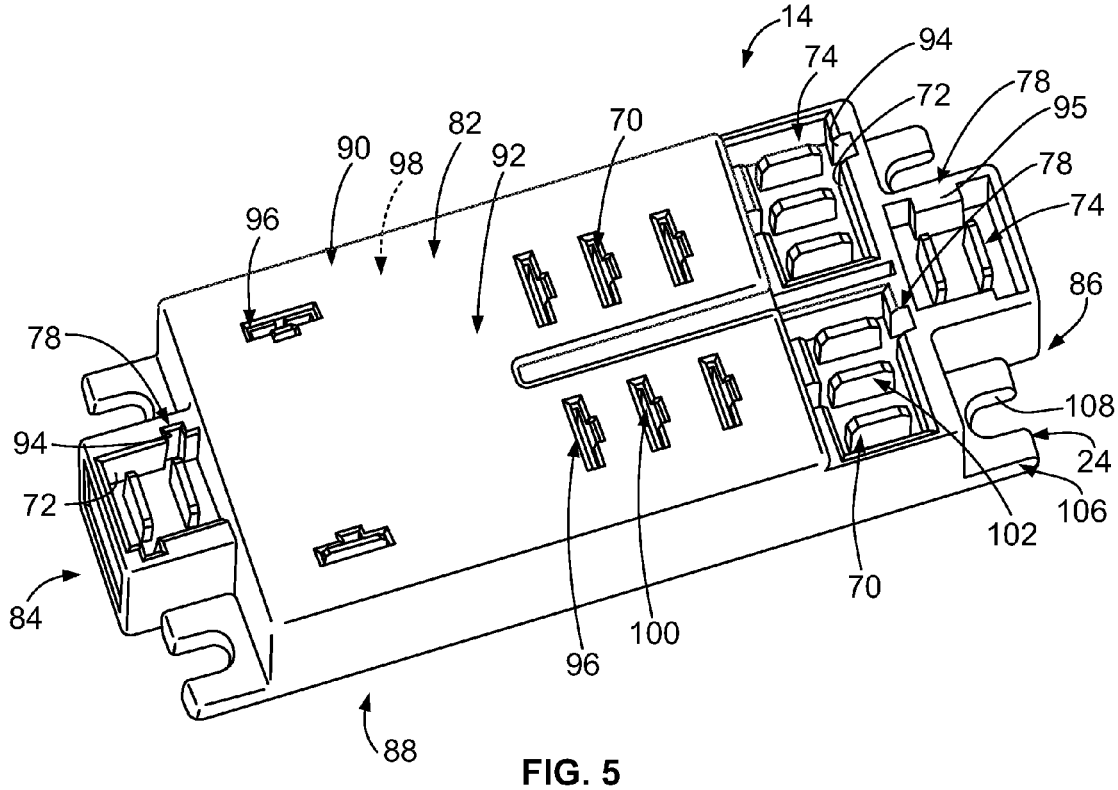
FIG. 5 is a perspective view of an exemplary embodiment of a socket connector of the socket connector assembly shown in FIG. 1.
Figure 6:
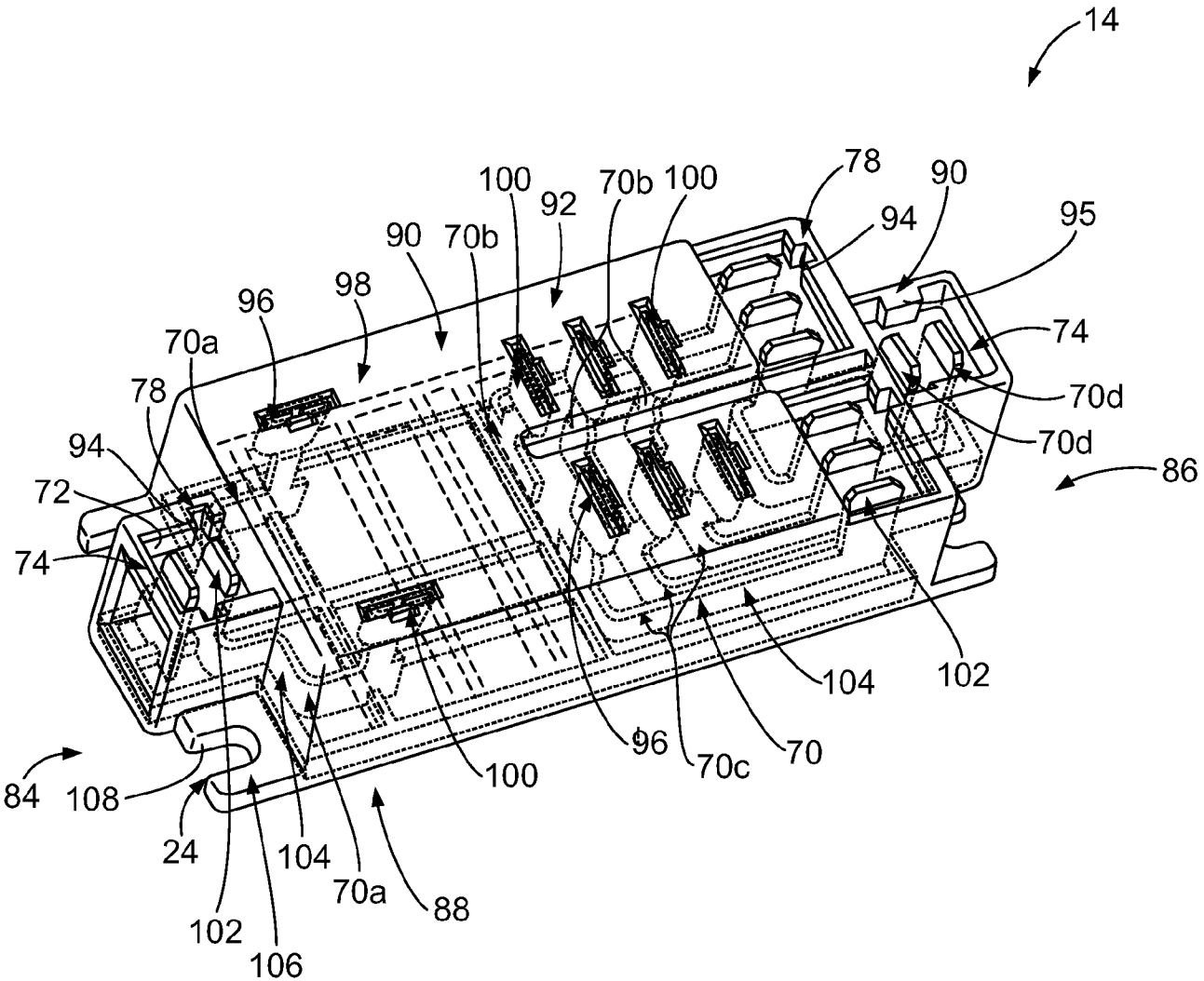
FIG. 6 is another perspective view of the socket connector shown in FIG. 5 with a housing of the socket connector shown in phantom.

FIG. 3 is a partially exploded perspective view of the electromagnetic relay 12. Referring now to FIGS. 2 and 3, the base 28 includes an engagement surface 52 that engages the socket connector 14 (FIGS. 1, 5, and 6) when the electromagnetic relay 12 is mounted on the socket connector 14. A plurality of relay contacts 54 extend through the base 28 and outwardly from the engagement surface 52 of the base 28. Specifically, in the exemplary embodiment, the electromagnetic relay 12 includes a pair of relay contacts 54*a* that are electrically connected to the coil 40, three relay contacts 54*b* that are electrically connected to the stationary contact 42, and three relay contacts 54*c* that are electrically connected to the stationary contact 44. Although eight relay contacts 54 are shown, the electromagnetic relay 12 may include any number of relay contacts 54 that are each electrically connected to any relay component(s) 30 of the electromagnetic relay 12. In the exemplary embodiment, each relay contact 54 is a plug contact that is configured to be received within a receptacle contact of the socket connector 14 (FIGS. 1, 5, and 6). Alternatively, one or more of the relay contacts 54 is a receptacle contact that is configured to receive a plug contact of the socket connector 14.

Figure 4:
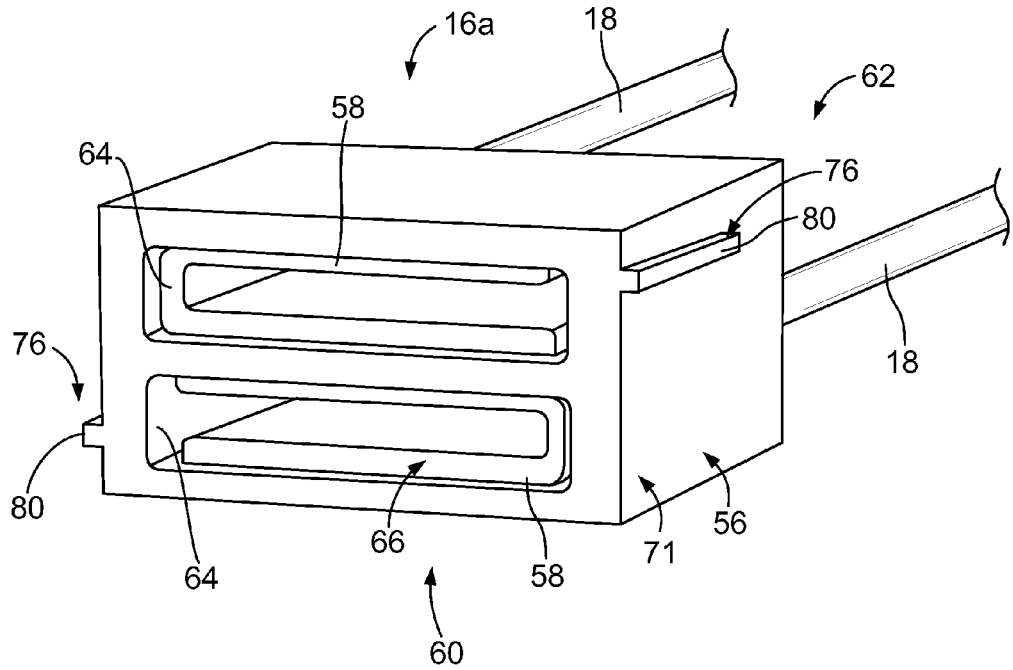
FIG. 4 is a perspective view of an exemplary embodiment of a mating connector of the socket connector assembly shown in FIG. 1.

FIG. 4 is a perspective view of an exemplary embodiment of one of the mating connectors 16*a*. Each mating connector 16 may be any type of connector, such as, but not limited to, a Raster Anschluss Steck Technik (RAST) connector, and/or the like. The mating connector 16 includes a housing 56 and a plurality of electrical contacts 58 held by the housing 56. The housing 56 extends from a mating end 60 to a wire entry end 62. In the exemplary embodiment, the mating end 60 of the housing 56 includes a plurality of contact channels 64. Each electrical contact 58 extends from a mating end 66 to a terminating end (not shown). The mating end 66 of each of the electrical contacts 58 extends within a corresponding one of the contact channels 64. Each contact mating end 66 is configured to engage a corresponding electrical terminal 70 (FIGS. 5 and 6) of the socket connector 14 (FIGS. 1, 5, and 6), as described below. In the exemplary embodiment, the mating end 66 of each electrical contact 58 is a receptacle contact that is configured to receive a plug contact of the of the socket connector 14 therein. Alternatively, one or more of the contact mating ends 66 is a plug contact that is configured to be received within a receptacle contact of the socket connector 14.

In the exemplary embodiment, the housing 56 defines a plug 71 that is configured to be received within a receptacle 72 (FIGS. 5 and 6) of a corresponding wire connector 74 (FIGS. 5 and 6) of the socket connector 14. Alternatively, the housing 56 defines a receptacle that is configured to receive a plug (not shown) of the corresponding wire connector 74 of the socket connector 14. The mating end 60 of the housing 56 optionally includes one or more keying elements 76 that cooperate with corresponding keying elements 78 (FIGS. 5 and 6) of the corresponding wire connector 74. In the exemplary embodiment, the keying elements 76 include extensions 80, although the keying elements 76 may additionally or alternatively include other structures, such as, but not limited to, slots (not shown).

The housing 56 includes one or more openings (not shown) extending into the wire entry end 62 for receiving the electrical wires 18 into the housing 56. In the exemplary embodiment, the housing 56 of the mating connector 16*a* receives two electrical wires 18. However, the housing 56 may receive any number of the electrical wires 18. The terminating end of each of the electrical contacts 58 extends within the opening (s) and is engaged with and electrically connected to the electrical conductor 20 (FIG. 1) of a corresponding one of the electrical wires 18. Although two electrical contacts 58 are shown, the mating connector 16*a* may include any number of the electrical contacts 58 and any number of the contact channels 64.

Referring again to FIG. 1, in the exemplary embodiment the socket connector assembly 10 includes four mating connectors 16*a*, 16*b*, 16*c*, and 16*d*. The socket connector assembly 10 may alternatively include any other number of mating connectors 16 for electrically connecting any number of electrical wires 18 to the socket connector 14. Except for the number of electrical contacts 58 and electrical wires 18, the mating connectors 16*b*, 16*c*, and 16*d* are substantially similar to the mating connector 16*a* and therefore will not be described in more detail herein.

FIG. 5 is a perspective view of an exemplary embodiment of the socket connector 14. FIG. 6 is another perspective view of the socket connector 14 with a housing 82 of the socket connector 14 shown in phantom. The housing 82 of the socket connector 14 extends a length from an end 84 to an opposite end 86. The housing 82 extends a height from a mounting side 88 to a relay side 90. The relay side 90 includes a relay mounting base 92 that is configured to receive the electromagnetic relay 12 (FIGS. 1-3) thereon. Specifically, the relay mounting base 92 engages the engagement surface 52 (FIGS. 2 and 3) of the electromagnetic relay 12 when the electromagnetic relay 12 is mounted on the housing 82 of the socket connector 14. The housing 82 of the socket connector 14 includes the mounting elements 24 for mounting the socket connector 14 on any structure and/or the like, such as, but not limited to, a panel, a din rail, a circuit board, and/or the like. In the exemplary embodiment, the mounting elements 24 includes flanges 106 having openings 108. The openings 108 receive fasteners 26 (FIG. 1) that connect to the circuit board 22 (FIG. 1) for holding the housing 82 on the circuit board 22. In addition or alternative to the flanges 106 and/or the openings 108, the housing 82 may include any other type and/or structure of mounting elements 24 for holding the housing 82 on any structure.

The relay side 90 of the housing 82 includes the wire connectors 74. The wire connectors 74 may each be any type of connector, such as, but not limited to, a Raster Anschluss Steck Technik (RAST) connector, and/or the like. In the exemplary embodiment, each wire connector 74 defines a receptacle 72 that receives the plug 71 (FIG. 4) of the corresponding mating connector 16 (FIGS. 1 and 4) therein. Each of the wire connectors 74 optionally includes one or more of the keying elements 78 that cooperate with the corresponding keying elements 76 (FIG. 4) of the corresponding mating connector 16. In the exemplary embodiment, the keying elements 78 include slots 94. Additionally or alternatively, the keying elements 78 include other structures, such as, but not limited to, extensions 95 and/or the like. Although four wire connectors 74 are shown, the housing 82 may include any number of wire connectors 74 for connecting to any number of mating connectors 16.

The housing 82 of the socket connector 14 includes a plurality of relay receptacles 96 extending into the relay side 90 along the relay mounting base 92. Each relay receptacle 96 is configured to receive a corresponding one of the relay contacts 54 (FIGS. 2 and 3) of the electromagnetic relay 12 therein. In the exemplary embodiment, the housing 82 includes eight relay receptacles 96. However, the housing 82 may include any number of the relay receptacles 96. Moreover, although each relay receptacle 96 receives a single relay contact 54 of the electromagnetic relay 12 therein in the exemplary embodiment, alternatively one or more of the relay receptacles 96 receives more than one relay contact 54 therein.

The socket connector 14 includes the plurality of electrical terminals 70. Specifically, the housing 82 includes one or more internal cavities 98 that hold at least a portion of each of the terminals 70 therein. Referring now to FIG. 6, terminals 70*a*, 70*b*, and 70*c* extend a length from a relay contact portion 100 to a connector contact portion 102. An intermediate link 104 extends between and connects the relay contact portion 100 and the connector contact portion 102 of the terminals 70*a*, 70*b*, and 70*c*. In the exemplary embodiment, the relay contact portion 100 and the connector contact portion 102 of each terminal 70*a*, 70*b*, and 70*c* includes opposite ends of the terminal 70. The relay contact portion 100 of each terminal 70*a*, 70*b*, and 70*c* extends within a corresponding one of the relay receptacles 96 for engagement and electrical connection with the corresponding relay contact 54 of the electromagnetic relay 12. In the exemplary embodiment, a single relay contact portion 100 is held within each relay receptacle 96. Alternatively, more than one relay contact portion 100 is held within one or more of the relay receptacles 96. Although in the exemplary embodiment each relay contact portion 100 is a receptacle contact that is configured to receive the corresponding relay contact 54 therein, alternatively one or more of the relay contact portions 100 is a plug contact that is configured to be received by receptacle contact of the electromagnetic relay 12.

The connector contact portion 102 of each terminal 70 extends within a corresponding one of the wire connectors 74 for engagement and electrical connection with the corresponding electrical contact 58 of the corresponding mating connector 16. Any number of the connector contact portions 102 may be held within each wire connector 74. In the exemplary embodiment, each connector contact portion 102 is a plug contact that is configured to be received by the corresponding electrical contact 58 of the corresponding mating connector 16. One or more of the connector contact portions 102 is alternatively a receptacle contact that is configured to receive the corresponding electrical contact 58 of the corresponding mating connector 16 therein.

Although the socket connector 14 may include any number of the terminals 70, in the exemplary embodiment the socket connector 14 includes ten of the terminals 70. Specifically, the terminals 70 include a pair of terminals 70*a* whose relay contact portions 100 are configured to engage and electrically connect to the relay contacts 54*a* (FIGS. 2 and 3) of the electromagnetic relay 12, three terminals 70*b* whose relay contact portions 100 are configured to engage and electrically connect to the relay contacts 54*b* (FIGS. 2 and 3) of the electromagnetic relay 12, and three terminals 70*c* whose relay contact portions 100 are configured to engage and electrically connect to the relay contacts 54*c* (FIGS. 2 and 3) of the electromagnetic relay 12. In the exemplary embodiment, the socket connector 14 also includes one or more power and/or ground terminals 70*d* for supplying electrical power and/or electrical ground to the terminals 70*a*, 70*b*, and/or 70*c*, and thereby to the electromagnetic relay 12. The power terminals 70*d* are connected to some or all of the terminals 70*a*, 70*b*, and/or 70*c* and do not include a relay contact portion 100.

Referring now to FIGS. 1 and 6, the electromagnetic relay 12 (not shown in FIG. 6) is received on the relay mounting base 92 of the socket connector housing 82 such that the engagement surface 52 (not shown in FIG. 6) of the electromagnetic relay 12 is engaged with the relay mounting base 92. Each relay contact 54 (FIGS. 2 and 3) of the electromagnetic relay 12 is received within the corresponding relay receptacle 96 (not visible in FIG. 1) of the socket connector 14. Each relay contact 54 is engaged with and electrically connected to the relay contact portion 100 (not visible in FIG. 1) of the corresponding relay receptacle 96. Specifically, the relay contacts 54*a* are engaged with and electrically connected to the relay contact portions 100 of the terminals 70*a*, the relay contacts 54*b* are engaged with and electrically connected to the relay contact portions 100 of the terminals 70*b*, the relay contacts 54*c* are engaged with and electrically connected to the relay contact portions 100 of the terminals 70*c*. The coil 40 (FIG. 2) of the electromagnetic relay 12 is thereby electrically connected to the terminals 70*a*, the stationary contact 42 (FIG. 2) of the electromagnetic relay 12 is thereby electrically connected to the terminals 70*b*, and the stationary contact 44 (FIG. 2) of the electromagnetic relay 12 is thereby electrically connected to the terminals 70*c*. The plugs 71 (FIG. 4) of the mating connectors 16*a*, 16*b*, 16*c*, and 16*d* are each received within the receptacle 72 (not visible in FIG. 1) of the corresponding wire connector 74. The electrical contacts 58 (FIG. 4) of the mating connectors 16*a*, 16*b*, 16*c*, and 16*d* are each engaged with and electrically connected to the connector contact portion 102 (not visible in FIG. 1) of the corresponding terminal 70*a*, 70*b*, 70*c*, and 70*d*, respectively. Accordingly, the socket connector 14 electrically connects the electrical wires 18 (not shown in FIG. 6) of the mating connectors 16 with the electromagnetic relay 12. Specifically, the terminals 70*a* of the socket connector 14 electrically connects the coil 40 of the electromagnetic relay 12 with the electrical wires 18 of the mating connector 16*a*, the terminals 70*b* electrically connect the stationary contact 42 of the electromagnetic relay 12 with the electrical wires 18 of the mating connector 16*b*, and the terminals 70*c* electrically connect the stationary contact 44 of the electromagnetic relay 12 with the electrical wires 18 of the mating connector 16*c*. The terminals 70*d* electrically connect the electrical wires 18 of the mating connector 16*d* with some or all of the other terminals 70*a*, 70*b*, and/or 70*c*.

The embodiments described and/or illustrated herein may provide an electromagnetic relay that is less likely to be mis-wired. The embodiments described and/or illustrated herein may provide an electromagnetic relay that is easier and/or less time-consuming to be operationally connected to an electricity source, an electrical outlet of the electromagnetic relay, and/or other electrical connections.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A socket connector for electrically connecting an electromagnetic relay to a plurality of electrical wires that are terminated by a mating connector, said socket connector comprising:

a dielectric housing comprising a relay mounting base and a wire connector, the relay mounting base comprising at least one relay receptacle, the relay mounting base being configured to receive the electromagnetic relay thereon; and a plurality of terminals held by the housing, each terminal comprising a relay contact portion and a connector contact portion, the relay contact portion extending within the at least one relay receptacle for electrical connection with the electromagnetic relay, the connector contact portion extending within the wire connector for electrical connection to the mating connector.

2. The socket connector according to claim 1, wherein the wire connector comprises a mating connector receptacle configured to receive the mating connector therein, the connector contact portion of at least some of the plurality of terminals extending within the mating connector receptacle.

3. The socket connector according to claim 1, wherein at least one of the plurality of terminals extends a length from the relay contact portion to the connector contact portion, an intermediate link extending between and connecting the relay and connector contact portions.

4. The socket connector according to claim 1, wherein the wire connector comprises a Raster Anschluss Steck Technik (RAST) connector.

5. The socket connector according to claim 1, wherein the housing comprises an internal cavity, at least a portion of each of the plurality of terminals extending within the internal cavity.

6. The socket connector according to claim 1, wherein the housing comprises a mounting element for mounting the housing on at least one of a panel, a din rail, and a circuit board.

7. The socket connector according to claim 1, wherein the relay contact portions of the plurality of terminals comprise receptacle contacts.

8. The socket connector according to claim 1, wherein the connector contact portions of the plurality of terminals comprise plug contacts.

9. The socket connector according to claim 1, wherein the relay mounting base of the housing comprises a plurality of relay receptacles, the relay contact portion of each of the plurality of terminals extending within a corresponding one of the relay receptacles.

10. The socket connector according to claim 1, wherein the relay contact portion and the connector contact portion of each of the plurality of terminals comprise opposite ends of the terminal.

11. A socket connector assembly for connection with a mating connector that terminates a plurality of electrical wires, said socket connector assembly comprising:

a socket connector comprising:

a dielectric housing comprising a relay mounting base and a wire connector, the relay mounting base comprising at least one relay receptacle; and a plurality of terminals held by the housing, each terminal comprising a relay contact portion and a connector contact portion, the relay contact portion extending within the at least one relay receptacle, the connector contact portion extending within the wire connector for electrical connection to the mating connector; and an electromagnetic relay received on the relay mounting base of the socket connector, the electromagnetic relay comprising a plurality of relay contacts, each relay contact being received within the at least one relay receptacle and engaged with the relay contact portion of a corresponding one of the plurality of terminals.

12. The socket connector assembly according to claim 11, wherein the wire connector comprises a mating connector receptacle configured to receive the mating connector therein, the connector contact portion of at least some of the plurality of terminals extending within the mating connector receptacle.

13. The socket connector assembly according to claim 11, wherein at least one of the plurality of terminals extends a length from the relay contact portion to the connector contact portion, an intermediate link extending between and connecting the relay and connector contact portions.

14. The socket connector assembly according to claim 11, wherein the wire connector comprises a Raster Anschluss Steck Technik (RAST) connector.

15. The socket connector assembly according to claim 11, wherein the electromagnetic relay comprises an engagement surface engaged with the housing at the relay mounting base of the housing, the relay contacts extending outwardly from the engagements surface.

16. The socket connector assembly according to claim 11, wherein the electromagnetic relay comprises a coil and a stationary contact, at least one of the relay contacts being electrically connected to the coil, at least one other relay contact being electrically connected to the stationary contact.

17. The socket connector assembly according to claim 11, further comprising the mating connector, the mating connector being mated with the wire connector such that the connector contact portions of the plurality of terminals are each electrically connected to the mating connector.

18. The socket connector assembly according to claim 11, wherein the relay contact portions of the plurality of terminals comprise receptacle contacts and the relay contacts comprise plug contacts.

19. The socket connector assembly according to claim 11, wherein the connector contact portions of the plurality of terminals comprise plug contacts.

20. The socket connector assembly according to claim 11, wherein the relay mounting base of the housing comprises a plurality of relay receptacles, the relay contact portion of each of the plurality of terminals extending within a corresponding one of the relay receptacles.

* * * * *